United States Patent [19]

Steffensmeier

[11] Patent Number: 4,582,311

[45] Date of Patent: Apr. 15, 1986

[54] HYDRAULICALLY CONTROLLED CHIROPRACTIC TABLE

[76] Inventor: Lloyd A. Steffensmeier, 122 W. Main, Lisbon, Iowa 52253

[21] Appl. No.: 546,085

[22] Filed: Oct. 27, 1983

[51] Int. Cl.[4] ..... A61G 13/00

[52] U.S. Cl. ..... 269/325

[58] Field of Search ..... 269/325, 324; 128/70–74; 188/300, 297, 314, 319; 267/64, 12

[56] References Cited

U.S. PATENT DOCUMENTS

| | | | |
|---|---|---|---|
| 2,700,583 | 1/1955 | Davis et al. | 269/325 |
| 3,241,828 | 3/1966 | Adolphson et al. | 269/325 |
| 3,993,051 | 11/1976 | Maruyama | 128/70 |
| 4,091,897 | 5/1978 | Andrepont | 188/314 |
| 4,159,822 | 7/1979 | Ota et al. | 269/325 |

FOREIGN PATENT DOCUMENTS

| | | | |
|---|---|---|---|
| 1021730 | 12/1957 | Fed. Rep. of Germany | 188/100 R |

*Primary Examiner*—Robert C. Watson
*Attorney, Agent, or Firm*—James C. Nemmers

[57] ABSTRACT

A chiropractic table that is hydraulically controlled for variable tension flexing. The pelvic section of the table is tilted by a hydraulic system that employs an accumulator which provides for control of manually-applied procedures. The use of hydraulics also requires less space than mechanical means thereby permitting additional functions to be combined into a single all-function table.

5 Claims, 6 Drawing Figures

HYDRAULICALLY CONTROLLED CHIROPRACTIC TABLE

BACKGROUND OF THE INVENTION

The basic chiropractic table that assists doctors of chiropractic in performing their procedures has been around for many many years. At the present time, such tables are divided into several sections that include a head cushion, a chest section, a pelvic assembly and a footstand and ankle rest. Each of these sections of the chiropractic table is independently movable to permit the doctor to perform a variety of chiropractic procedures. Most such tables are largely mechanically movable to various positions used in chiropractic procedures. Tables are also known and used which use hydraulics to perform many of the functions previously performed mechanically. However, when applied to certain procedures, hydraulics has not provided the necessary and proper control to properly conduct the chiropractic procedure. This is true of the pelvic section which when moved to a selected position at the start of a procedure must allow controlled movement of the pelvic section as the doctor manually applies force to the proper locations on the patients body. Therefore, the pelvic section of chiropractic tables has commonly been designed with a mechanical support with a spring mechanism providing resistance to movement during a selected chiropractic procedure. Such mechanisms however take up a considerable amount of space thus preventing multifunction mechanisms from being incorporated into the table. With certain procedures, this sometimes results in the necessity of using of two different chiropractic tables and moving the patient from one to the other to complete the treatment.

There is therefore a need for improvements in chiropractic tables which would permit all necessary and usual procedures to be performed on a single table. There is also a need for a chiropractic table which has a pelvic section that allows for better control of the initial movement and the return movement during certain chiropractic procedures. It is further desirable that any such multifunction table be made so as to be simple to use and relatively low in cost.

SUMMARY OF THE INVENTION

The improved chiropractic table of the invention employs a hydraulic system for the table, including the pelvic section, which hydraulic system uses an accumulator in order to provide controlled resistence of return movement of that section. Use of hydraulics in the invention to provide for controlled pivoting of the pelvic section allows sufficient space so that other means can also be installed on the table for rotating the pelvic section when needed in certain procedures. In addition, sufficient space is provided to allow the pelvic and ankle section to be extended for traction. The use of hydraulics also permits a positive lock of the pelvic section in a selected position without the necessity of any mechanical latch thus simplifying the use of the table by the doctor.

DESCRIPTION OF THE PREFERRED EMBODIMENT OF THE INVENTION

Figure 1:
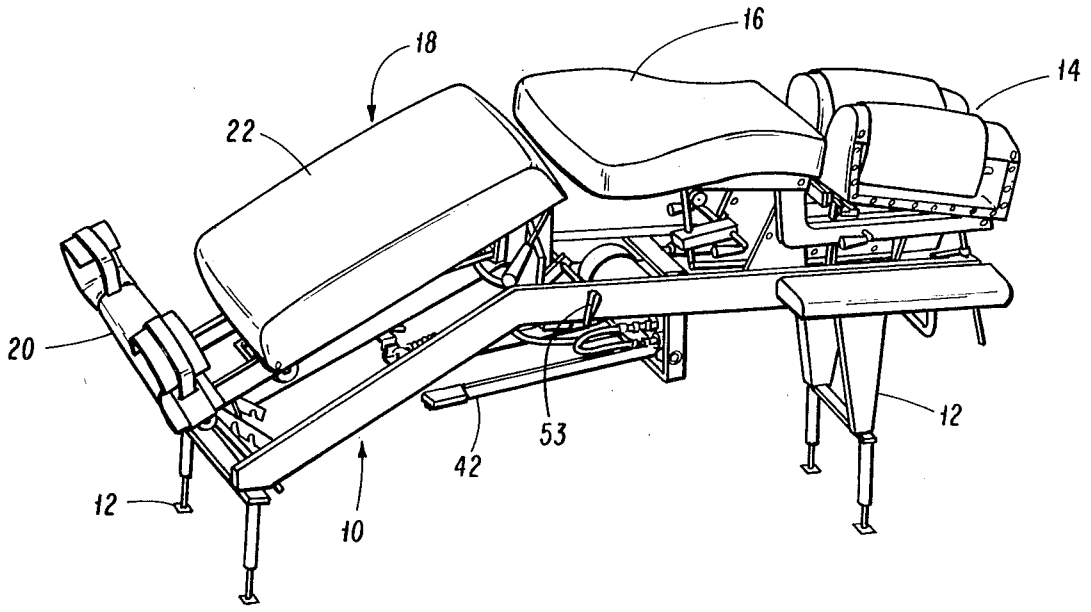
FIG. 1 is a perspective view of a chiropractic table that incorporates the principles of the invention.

Referring to FIG. 1, the chiropractic table consists of a main frame 10 that is somewhat rectangular in shape and supported at each end by legs 12. At one end of the frame, there are mounted for independent movement a pair of head cushions 14 adjacent to which is a chest cushion 16. Mounted independently on frame 10 is a pelvic section indicated generally by the reference numberal 18. At the end of the main frame 10 opposite the head cushion 14 is a footstand and ankle rest 20. Each of the various sections of the chiropractic table are mounted for movement independently of each other so that each section can be raised and lowered to various angles in order to carry out the desired chiropractic procedure.

As indicated in the Summary of the Invention, the invention relates to the pelvic section 18 and the manner in which it is mounted on the main frame 10 and the way in which movement of the pelvic section 18 is controlled. Other than the pelvic section, the chiropractic table illustrated in FIG. 1 is a somewhat standard, commercially available chiropractic table that is hydraulically operated.

Figure 2:
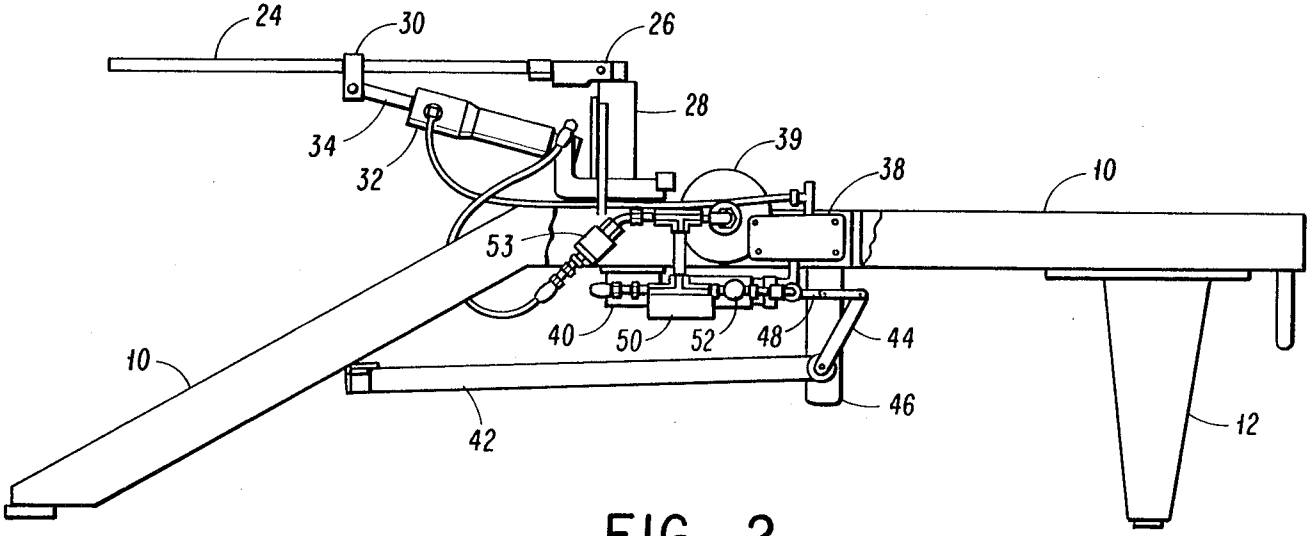
FIG. 2 is a side elevational view of a portion of the chiropractic table of FIG. 1 but showing only the hydraulic mechanism for the pelvic section, with the pelvic cushion removed.
Figure 3A:
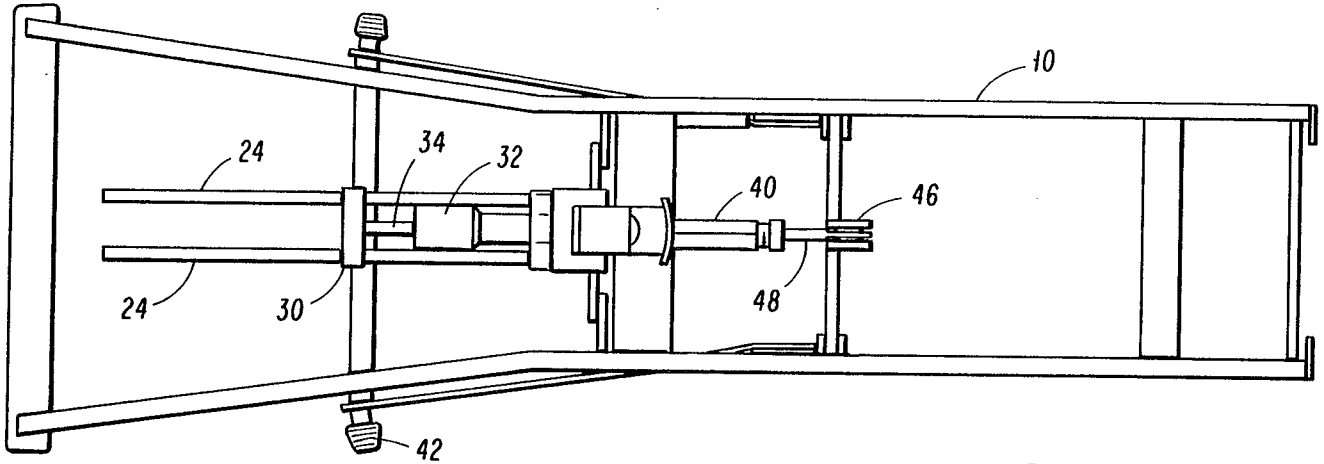
FIG. 3A is a top or plan view of the chiropractic table of FIG. 2A.
Figure 2A:
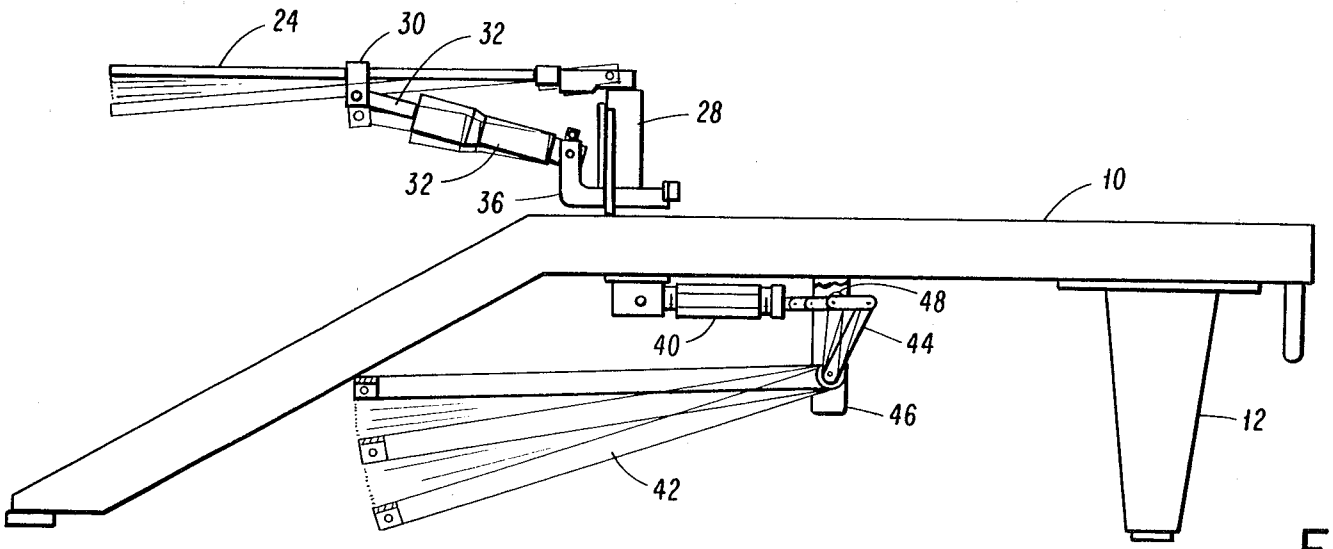
FIG. 2A is a side elevational view similar to FIG. 2 but showing much of the hydraulic system removed so as to illustrate movement of the pivoting mechanism for the pelvic section.

Referring now to FIGS. 2, 2A, 3 and 3A, the invention will be described in detail. The pelvic section has a cushion 22 which is secured to a pair of supporting arms 24 which are pivotally mounted at 26 to an upright support 28 secured to the main frame 10. A cross-member 30 connects the supporting arms 24 near their center, and a hydraulic cylinder 32 has its operating rod 34 pivotally connected to the cross-member 30. The hydraulic cylinder 32 is pivotally mounted at its non-operating end to a supporting bracket 36 which is also connected to and supported by the main frame 10. Thus, when the hydraulic cylinder 32 is actuated and the operating rod 34 moved, the supporting arms 24 will be pivoted upwardly and downwardly as illustrated in FIG. 2A.

Figure 3:
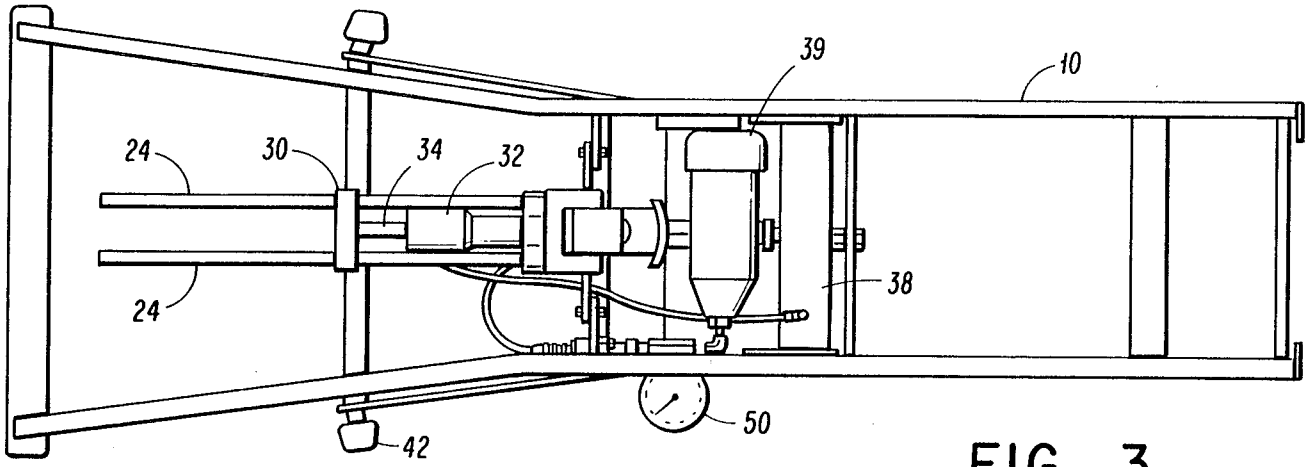
FIG. 3 is a top or plan view of that portion of the chiropractic table shown in FIG. 2.

As best seen in FIGS. 2 and 3, the main frame 10 also supports a hydraulic reservoir 38 and an accumlator 39. In addition, a hydraulic pump 40 is mounted on the frame 10, the pump either being electrically or manually operated. In the embodiment disclosed, there is illustrated a mechanism for manually operating the pump. This mechanism includes an operating arm 42 that is joined to a crank 44 by a pivotal connection on a depending support 46. The crank in turn is connected to the operating rod 48 of the hydraulic pump 40.

Figure 4:
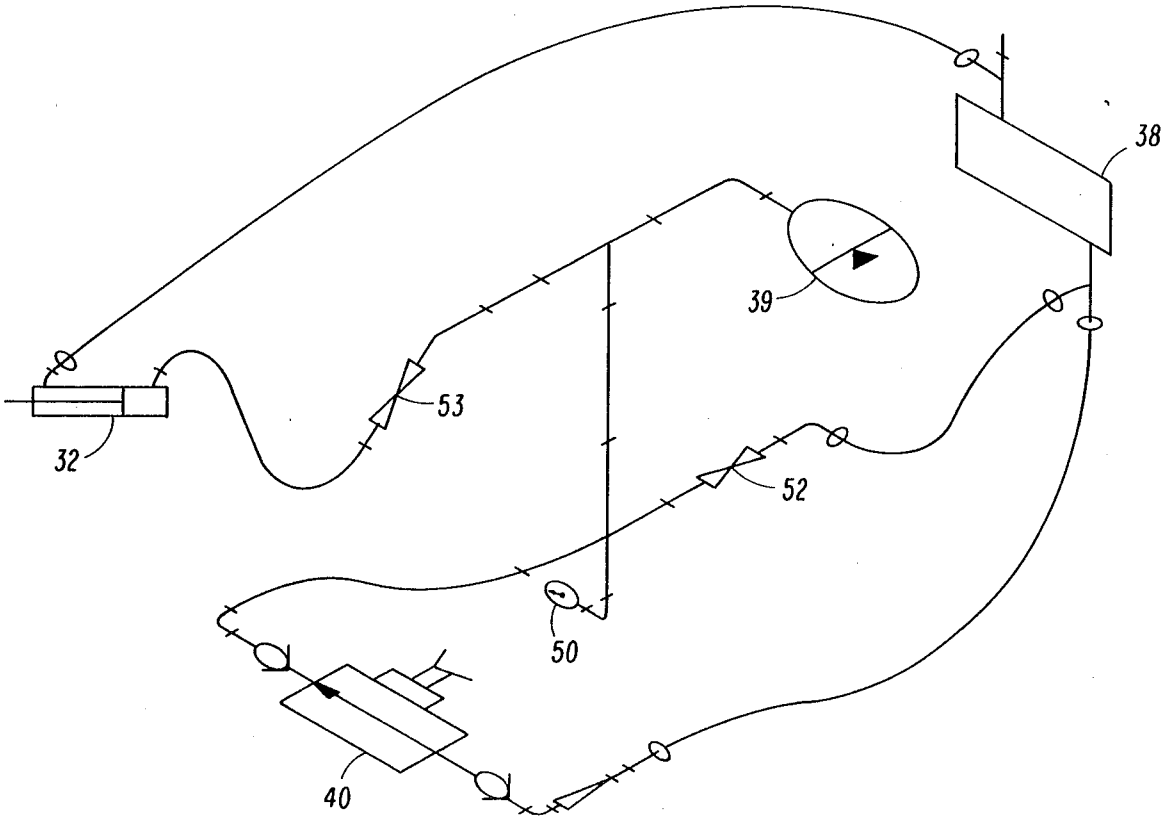
FIG. 4 is a schematic diagram of the hydraulic system for the pelvic section.

As best seen in FIG. 4, but also partially illustrated in FIGS. 2 and 3, the hydraulic system is a closed system which includes the reservoir 38 and the accumulator 39. When pressure is applied to the system by the hydraulic pump 40 by manually operating the operating arm 42, pressure is also applied to the accumulator 39. A control valve 52 is manually actuated to control the amount of pressure applied to the accumulator 39 and hydraulic cylinder 32, the amount of pressure being displayed on gauge 50.

With the pelvic cushion 22 in a normal, raised position as shown in FIG. 2, the valve 53 can be closed to maintain the pressure on cylinder 32 and hold the cushion 22 in the selected position while the patient is placed on the table. If the system and accumulator 39 is pressurized to the desired level, valve 53 is opened and tilting downward of the pelvic cushion 22 will be resisted by the pressure in the accumulator 39. Then, during the procedure when the doctor manually applies force to a selected part of the patient's body the force will be resisted by the pressure of the accumulator 39, and if the pelvic cushion 22 tilts, it will be returned to its original position when the doctor releases the manually applied force. The control valve 52 can be operated to vary the amount of resistance applied by the accumulator 39. Thus, use of the accumulator 39 allows the doctor to obtain precise control of movement of the pelvic cushion 22 during the entire procedure. Moreover, by closing off completely the control valve 53, the pelvic cushion 22 can be locked in any selected position without the necessity of a mechanical latch.

By viewing FIGS. 2 and 3, it can be seen that the hydraulic system even with the accumulator 39 takes up a minimum amount of space between the pelvic cushion 22 and the frame 10. Therefore, if desired, the pelvic cushion 22 can also be mounted employing means to rotate the cushion about a horizontal longitudinal axis and from side to side. However, where so employed, there is insufficient room to incorporate the commonly known and used mechanical-spring mechanism for tilting of the pelvic cushion. The invention thus permits a table to incorporate means for performing all functions on a single table whereas presently separate tables must be used for each separate movement of the pelvic cushion.

In addition, use of the hydraulics provides sufficient room to allow longitudinal extension of the footstand and ankle rest 20 where it is desired to apply traction to patient.

It will be thus seen to those skilled in the art, and especially to Doctors of Chiropractic, that a chiropractic table that incorporates the principles of the invention can then be used to perform almost all necessary chiropractic procedures. Thus, the necessity of having different tables for different procedures is eliminated. The system of the invention is relatively inexpensive, especially where manually operated, and provides precise control of the action of the pelvic section during all procedures. By merely operating the control valve in the hydraulic system, an infinite number of resistences can be provided thus improving the chiropractic techniques.

Having thus described the invention in connection with a preferred embodiment, it will be evident to those skilled in the art that various revisions and modifications can be made to the preferred embodiment without departing from the spirit and scope of the invention. It is my intention however that all such revisions and modifications as are obvious to those skilled in the art will be included within the scope of the claims.

What is claimed is:

1. A chiropractic table comprising a supporting frame, a plurality of independently movable sections including a pelvic section mounted on the supporting frame, the pelvic section being mounted on the frame for pivotal movement upwardly and downwardly, a hydraulic cylinder having an operating rod operatively connected to the pelvic section to control its pivotal movement, a system of pressurized fluid connected to the hydraulic cylinder, means for varying the amount of pressure in the system and to the hydraulic cylinder, and an accumulator connected in the system and directly to the hydraulic cylinder to provide for variable resistance to exterior force applied to the pelvic section and therefore to the operating rod of the hydraulic cylinder, such resistance returning the section to its original position upon removal of the exterior force to thereby control pivotal movement of the pelvic section.

2. The chiropractic table of claim 1 in which a valve is provided in the system between the hydraulic cylinder and the accumulator to selectively maintain the pressure in the hydraulic cylinder and thereby provide for locking the pelvic cushion in a selected position.

3. The chiropractic table of claim 1 in which the system includes a hydraulic pump for supplying pressure to the system.

4. The chiropractic table of claim 3 in which the hydraulic pump is operated by a manually operated lever operatively connected to the hydraulic pump and mounted on the supporting frame.

5. The chiropractic table of claim 2 in which a control valve is included in the system for varying the amount of pressure in the accumulator, the control valve being manually operated.

* * * * *